US006243890B1

(12) United States Patent
Yang

(10) Patent No.: US 6,243,890 B1
(45) Date of Patent: Jun. 12, 2001

(54) THREE-IN-ONE MULTIFUNCTIONAL BABY BATHTUB

(76) Inventor: Chao-Chun Yang, No. 16, Alley 32, Lane 61, Cheng Kung Road, Sec. 4, Taipei (TW)

( * ) Notice: Subject to any disclaimer, the term of this patent is extended or adjusted under 35 U.S.C. 154(b) by 0 days.

(21) Appl. No.: 09/576,796

(22) Filed: May 23, 2000

(30) Foreign Application Priority Data

Feb. 3, 2000 (CN) ..... 089202176

(51) Int. Cl.[7] ..... A47K 3/024

(52) U.S. Cl. ..... 4/572.1; 4/573.1; 4/594; 4/621

(58) Field of Search ..... 4/571.1, 572.1, 4/573.1, 584, 592, 594, 621

(56) References Cited

U.S. PATENT DOCUMENTS 1,512,068 * 10/1924 Thronburg ..... 4/572.1
5,181,284 * 1/1993 Raphael et al. ..... 4/572.1
5,269,260 * 12/1993 Farrell et al. ..... 4/571.1
5,588,159 * 12/1996 Poulson et al. ..... 4/572.1
6,112,343 * 9/2000 Dixon ..... 4/571.1

FOREIGN PATENT DOCUMENTS

2053673 * 2/1981 (GB) ..... 4/571.1

* cited by examiner

*Primary Examiner*—Charles R. Eloshway
(74) *Attorney, Agent, or Firm*—Rabin & Champagne, P.C.

(57) ABSTRACT

A bathtub includes an integrally formed rectangular body with a recess having an appropriate depth. The four corners of the body are formed with four cylindrical holes. The bathtub is provided with positioning indents on the surface of the recess for fastening a shaped pad therein. The shaped pad, which is molded according to the shape of a baby, can be used to prop up a baby for washing. When the pad is removed, the bathtub can be used to wash a bigger baby. The space inside the bathtub can also be used as a parcel barrel. The cylindrical holes on the four corners can be inserted with legs of different length in order to lift up the bathtub for the ease of an adult to wash a baby. Alternatively, the legs can be inserted in the opposite direction and the bathtub can be upside down so that the construction can be used as an end table or a study desk, etc.

8 Claims, 3 Drawing Sheets

FIG. 2
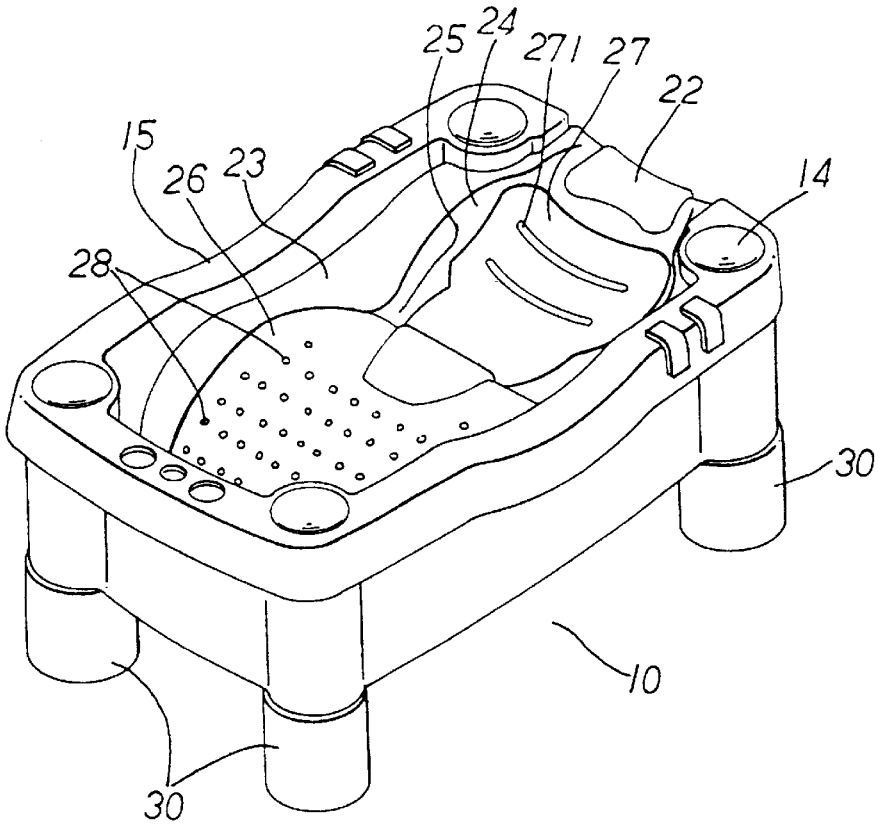
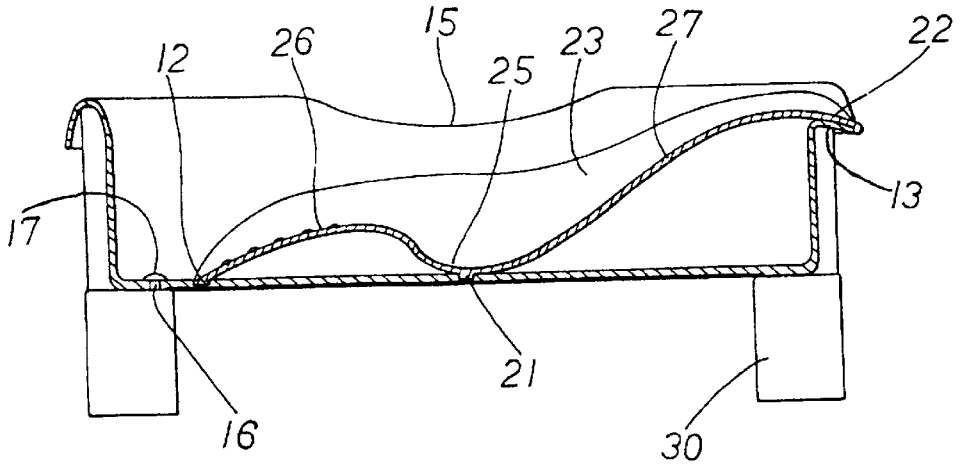
FIG. 3

FIG. 4
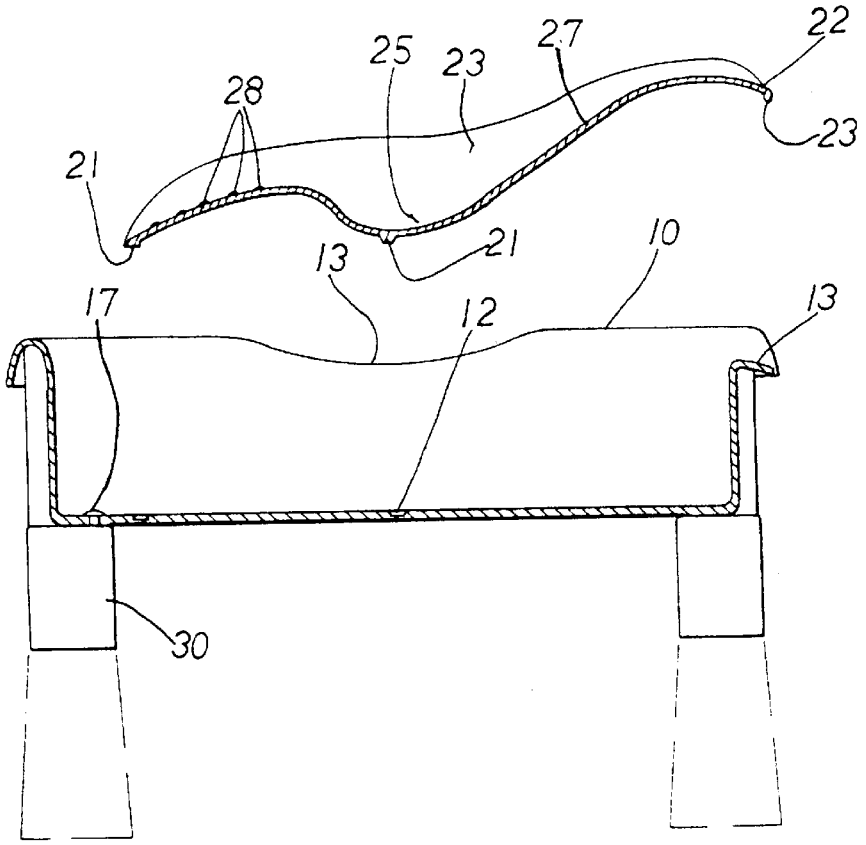
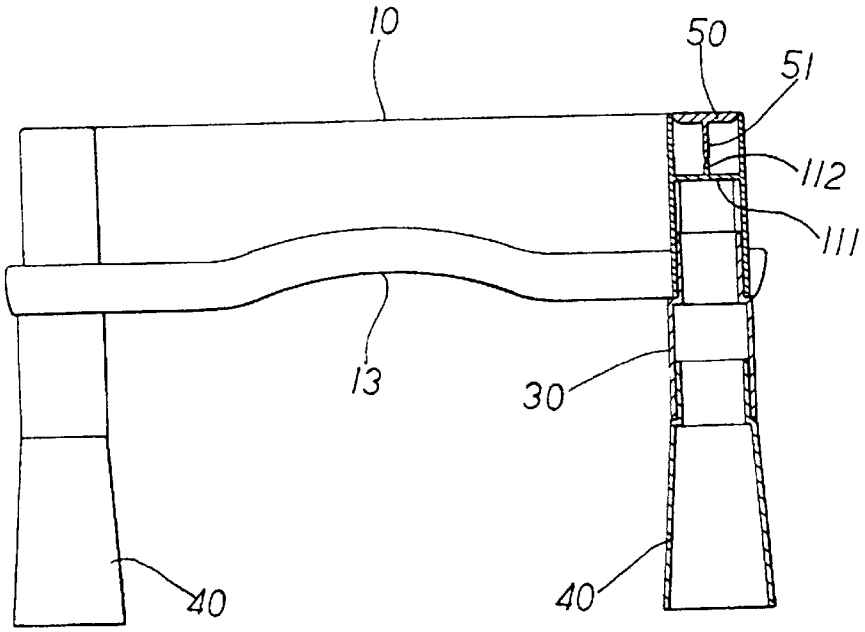
FIG. 5

THREE-IN-ONE MULTIFUNCTIONAL BABY BATHTUB

FIELD OF THE INVENTION

The present invention is related to a bathtub for a baby, and in particular to a bathtub for a baby which still can be used for other purposes when the baby grows up.

BACKGROUND OF THE INVENTION

Generally speaking, baby products have a high turnover rate. Since a baby has different needs during his/her growing process, different articles are needed during different stages of the baby and the life cycles of those articles usually are not very long. In many cases, the articles are out of date when they are still quite new and usable, and new articles are needed. In the old days when a family usually had many children, articles used by an older child can be used by the younger one(s). In modern days, however, a family usually has one or two children. As a result, many families have a large collection of baby products which can no longer be used and are a pity to be thrown away.

Take bathing a baby as an example, in a case where an ordinary round bathtub is used to wash a baby. If the space in the bathtub is quite large, the baby essentially can swim in there. When a tiny and soft baby is being washed in the bathtub, the weight of the whole baby needs to be supported by one hand of an adult leaving only one hand to do the washing work and making the washing work an inconvenient one. Even though a bathtub specially designed for washing an infant is available on the market, the geometry thereof is fixed and can only be used during a baby's infant stage which is rather short. A year later, when the baby grows to a bigger size, the bathtub will no longer be suitable for use.

Therefore, the objective of the present invention is to design a versatile bathtub that can be used for a baby from the infant stage to a big baby, while the bathtub can be used in other applications to expand its value and obtain environmental benefits.

SUMMARY OF THE INVENTION

The main objective of the present invention is to provide a three-in-one multifunctional baby bathtub having a device for supporting the body of a baby therein, which is easy to assemble/disassemble. Alternatively, the support device can be removed to present a larger space of the bathtub for a bigger baby to bath therein and extending the life of the bathtub.

Another objective of the present invention is to provide a three-in-one multifunctional baby bathtub that has legs, which can be used to lift the bathtub to a height convenient for an adult to bath the baby.

Still another objective of the present invention is to provide a three-in-one multifunctional baby bathtub that can be extended for other use thereby fully utilizing its residual value while meeting environmental demands.

In order to achieve the above objectives, a three-in-one multifunctional bathtub constructed according to the present invention comprises an integrally formed rectangular body having a recess with an appropriate depth surrounded by four upright sidewalls; and a shaped pad, wherein the body is formed with four cylindrical holes at four corners thereof, each of which is provided with a dividing plate having a protruding rib at its center section, wherein a lower opening of the cylindrical hole can be inserted with a leg to prop up the bathtub for adapting to the height of an adult, two opposite sidewalls of said four upright sidewalls have two concave arcs at their upper edges, the recess of the bathtub is provided with a water outlet and a positioning indent for fastening said shaped pad at its bottom surface, wherein the shaped pad after being fastened in the recess has a shape to receive a baby in a lying position with a head end thereof corresponding to a baby head being received in an indent arc provided at an upper edge of one of the upright sidewalls which is located between said two opposite sidewalls so that said baby head is propped up.

Preferably, the shaped pad bathtub is removable after being fastened in the recess of the bathtub, so that the bathtub can be used to wash a bigger baby when the shaped pad is removed.

Preferably, the shaped pad has two lateral lips and a concave central portion between the two lateral lips, and the shaped pad has a first descending section, a second descending section and an ascending section bridging the first and the second descending sections from the head end to a rear end thereof, such that the first descending section below the head end is used to support a back of the baby while allowing a hip of the baby to sit on an arc formed by the first descending section and the ascending section, and legs of the baby to rest on the second descending section.

Preferably, the shaped pad is provided with a wrapping lip at the head end thereof, and is provided with positioning protrusions underneath the concave central portion thereof corresponding to said positioning indents, wherein the positioning protrusions are coupled to said positioning indents and the wrapping lip buckle said indent arc of said one of the upright sidewalls, when the shaped pad is received in the recess of the bathtub.

Preferably, the head end of the shaped pad has a pillow structure for the comfort of the head of the baby to rest on; the first descending section is covered with a layer of a soft material for the comfort of the back of the baby to rest on, and is provided with anti-slippage strips.

Peferably, the three-in-one multifunctional bathtub of the present invention further comprises four multi-section legs to be inserted in the four cylindrical holes of the bathtub in one direction, so that a height of the bathtub can be varied for adapting to the height of an adult washing the baby in the bathtub.

Preferably, the multi-section legs and the four cylindrical holes are so constructed that the multi-section legs can also be inserted into the four cylindrical holes in a second direction opposite to the first direction, and thus the bathtub can stand upside down to be used as an end table or a study desk.

Preferably. the three-in-one multifunctional bathtub of the present invention further comprises four T-shaped decorative covers for the four cylindrical holes having a round disc and a perpendicular plate on the round disc, wherein the round disc covers the cylindrical hole and the perpendicular plate contacts the protruding rib of the dividing plate of the cylindrical hole when the T-shaped decorative cover is received in the cylindrical hole in the first direction.

BRIEF DESCRIPTION OF THE DRAWINGS

FIG. 2: A 3-D assembly of the bathtub shown in FIG. 1;

FIG. 3: A cross section view of the bathtub shown in FIG. 2;

FIG. 4: A cross section view of a second preferred embodiment of the present invention;

FIG. 5: A cross section view of a third preferred embodiment of the present invention;

LEGENDS

Figure 1:
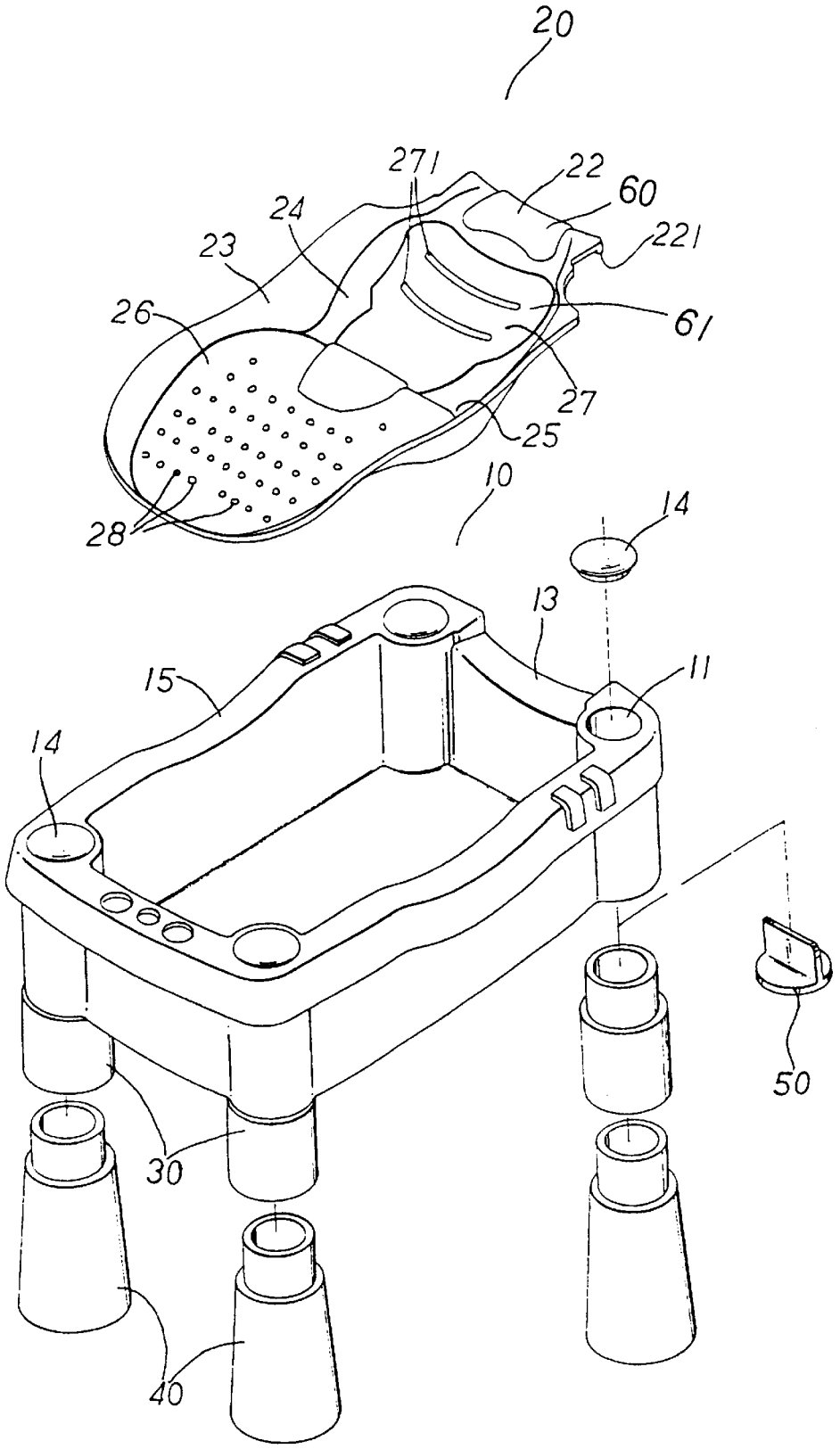
FIG. 1: A 3-D exploded view of a bathtub according to a first preferred embodiment of the present invention.

10 Rectangular bathtub body
11 Cylindrical hole
111 Dividing plate
112 Protruding rib
12 Positioning indent
13 Indent arc of the head end
14 Round decorative cover
15 Concave arc
16 Water outlet hole
17 Plug
20 Shaped pad
21 Positioning protrusion
22 Head end
221 Wrapping lip
23 Lateral lip
24 First descending section
25 Arc
26 Second descending section
27 Back-support section
271 Anti-slippage strip
28 Protrusion particles
30 Leg
40 Extension leg
50 T-shaped decorative cover
51 Perpendicular plate

DETAILED DESCRIPTION OF THE PREFERRED EMBODIMENTS

FIG. 1 is a schematic 3-D exploded view of a baby bathtub according to the present invention, which comprises essentially an integrally formed rectangular body 10 with a recess having an appropriate depth. The four corners of the body are formed with four cylindrical holes 11. The center section of each cylindrical hole is installed with a dividing plate 111 having a protruding rib 112 thereon, as shown in FIG. 5. The surface of the bottom of the bathtub is indented with positioning indents 12 for fastening a shaped pad 20 on the bottom of the bathtub together with positioning protrusions 21 of said shaped pad 20, as shown in FIG. 3 and FIG. 4.

The shaped pad 20 is integrally formed, and it has two lateral lips 23 and a lower central portion consisting of a head end 22, a first slant section 24, an indent arc 25, an ascending section, and a second slant section 26. The first slant section 24 following the head end 22 is used to support the back of a baby while allowing the hip of the baby to sit on the indent arc 25, and the ascending section and the second slant section 26 following the indent arc 25 can support the thighs and legs of the baby. The head end 22 of the shaped pad 20 is downwardly protruded with a wrapping lip 221. The positioning protrusions 21 corresponding to the positioning indents 12 on the surface of the bathtub bottom are formed below the indent arc 25 and at the end of the second slant section 26 of the shaped pad 20. The wrapping lip 221 at the head end 22 is used to buckle the shaped pad 20 to an indent arc 13 of one sidewall of the body 10 while the positioning protrusions 21 are in engagement with the positioning indents 12. The head end 22 can be covered with a layer of a soft material 50 to form a head pillow section for the comfort of the head of a baby to rest on, the middle of the first slant section 24 is slightly indented or covered with a layer of a soft material 51 to form a back-support section 27 for the comfort of the back of a baby to rest on, the upper side of the back-support section 27 can further be protrudedly installed with transverse anti-slippage strips 271, and the surface of the second slant section 26 is installed with anti-slippage protrusion particles 28.

The cylindrical holes 11 on the four corners of the body 10 can each be inserted with a leg 30 and/or a larger extension leg 40 to prop up the bathtub 10 and adapt to the operation of an adult. The opening on the cylindrical hole 11 can be covered by a round decorative cap 14 for safety and cosmetic reasons. The upper edges of the two lateral sidewalls have appropriate concave arcs 15. Furthermore, the water outlet 16 penetrating the bathtub bottom can be covered by a plug 17 made of a soft rubber and having a safe surface curvature, as shown in FIG. 3 and FIG. 4. The assembly of the above components is shown in FIG. 2.

FIG. 3 shows a schematic cross section of an assembled bathtub according to the present invention. The shaped pad 20, after being assembled, can provide a support to a baby while washing the baby such that the washing can be carried out more efficiently and promptly. Furthermore, the head end 22 of the shaped pad 20 can prop up the baby's head so that his/her eyes will not get wet when the baby's hair is being washed. The concave arc 15 on the two sidewalls enables the convenience for the washing operation. The plug 17 made of a soft rubber covering the water outlet 16 at the bottom of the bathtub can avoid irritation to the baby's skin.

FIG. 4 shows a cross section of a second embodiment according to the present invention. The shaped pad 20, after being removed from the bathtub, can provide a larger space to the bathtub for washing a bigger baby. When a baby grows too big to be washed in the bathtub, the bathtub can be used as a parcel barrel for fully utilizing the bathtub and meeting environmental requirements.

FIG. 5 shows a cross section of a third embodiment according to the present invention. The legs 30 and 40 can be reversely inserted into the upward-facing openings and the whole assembly is inverted. The cylindrical holes 11 on the bottom of the body 10 are covered with a T-shaped decorative cover 50 to flatten the cylindrical holes 11 of the body 10 so that the assembly can be used as an end table or a study desk, etc. When the T-shaped decorative cover 50 covers the cylindrical hole, a perpendicular plate 51 of the T-shaped decorative cover 50 contacts the protrusion rib 112 of the dividing plate 111 in the cylindrical hole 11. When dismantling the assembly, the T-shaped decorative cover 50 can be pressed to form a slope for the convenience of dismantling without the need of using tools, because the perpendicular plate 51 contacts the protrusion rib 112 of the dividing plate 111 of the cylindrical hole 11.

What is claimed is:

1. A three-in-one multifunctional bathtub comprising an integrally formed rectangular body having a recess with an appropriate depth surrounded by four upright sidewalls; and a shaped pad, wherein the body is formed with four cylindrical holes at four corners thereof, each of which is provided with a dividing plate having a protruding rib at its center section, wherein a lower opening of each cylindrical hole is adapted to receive a leg to prop up the bathtub for adapting to the height of an adult, two opposite sidewalls of said four upright sidewalls have two concave arcs at their upper edges, the recess of the bathtub is provided with a water outlet and at least one positioning indent for fastening said shaped pad thereto at its bottom surface, wherein the shaped pad after being fastened in the recess has a shape to receive a baby in a lying position with a head end of said pad being received in an indent arc provided at an upper edge of one of the upright sidewalls which is located between said two opposite sidewalls so that said baby head is propped up.

2. The three-in-one multifunctional bathtub as claimed in claim 1, wherein the shaped pad bathtub is removable after being fastened in the recess of the bathtub, so that the bathtub can be used to wash a bigger baby when the shaped pad is removed.

3. The three-in-one multifunctional bathtub as claimed in claim 1, wherein the shaped pad has two lateral lips and a concave central portion between the two lateral lips, and the shaped pad has a first descending section, a second descending section and an ascending section bridging the first and the second descending sections from the head end to a rear end thereof, such that the first descending section is below the head end and is used to support a back of the baby while allowing a hip of the baby to sit on an arc formed by the first descending section and the ascending section, and legs of the baby to rest on the second descending section.

4. The three-in-one multifunctional bathtub as claimed in claim 3, wherein the shaped pad is provided with a wrapping lip at the head end thereof, and is provided with at least one positioning protrusion underneath the concave central portion thereof corresponding to said at least one positioning indent, wherein the at least one positioning protrusion is coupled to said at least one positioning indent and the wrapping lip wraps over said indent arc of said one of the upright sidewalls, when the shaped pad is received in the recess of the bathtub.

5. The three-in-one multifunctional bathtub as claimed in claim 3, wherein the head end of the shaped pad has a pillow structure for the comfort of the head of the baby to rest on; the first descending section is covered with a layer of a soft material for the comfort of the back of the baby to rest on, and is provided with anti-slippage strips.

6. The three-in-one multifunctional bathtub as claimed in claim 1 further comprising four multi-section legs to be inserted in the four cylindrical holes of the bathtub in one direction, so that a height of the bathtub can be varied for adapting to the height of an adult washing the baby in the bathtub.

7. The three-in-one multifunctional bathtub as claimed in claim 6, wherein the multi-section legs and the four cylindrical holes are so constructed that the multi-section legs can also be inserted into the four cylindrical holes in a second direction opposite to the first direction, and thus the bathtub can stand upside down to be used as an end table or a study desk.

8. The three-in-one multifunctional bathtub as claimed in claim 7 further comprising four T-shaped decorative covers for the four cylindrical holes having a round disc and a perpendicular plate on the round disc, wherein the round disc covers the cylindrical hole and the perpendicular plate contacts the protruding rib of the dividing plate of the cylindrical hole when the T-shaped decorative cover is received in the cylindrical hole in the first direction.

* * * * *